US006309364B1

(12) United States Patent
Cathaud et al.

(10) Patent No.: US 6,309,364 B1
(45) Date of Patent: Oct. 30, 2001

(54) MASSAGE AND SKIN SUCTION APPARATUS

(75) Inventors: Muriel Cathaud, Toussieu; Jean-Pascal Delay, Ecully, both of (FR)

(73) Assignee: SEB, Ecully (FR)

( * ) Notice: Subject to any disclaimer, the term of this patent is extended or adjusted under 35 U.S.C. 154(b) by 0 days.

(21) Appl. No.: 09/367,448

(22) PCT Filed: Dec. 15, 1998

(86) PCT No.: PCT/FR97/02738

§ 371 Date: Oct. 5, 1999

§ 102(e) Date: Oct. 5, 1999

(87) PCT Pub. No.: WO99/30666

PCT Pub. Date: Jun. 24, 1999

(30) Foreign Application Priority Data

Dec. 16, 1997 (FR) ..... 97/16447
Apr. 22, 1998 (FR) ..... 98/05849

(51) Int. Cl.[7] ..... A61H 7/00

(52) U.S. Cl. ..... 601/7; 601/122; 601/125; 601/126; 601/133

(58) Field of Search ..... 601/6, 7, 8, 9, 601/10, 121–133

(56) References Cited

U.S. PATENT DOCUMENTS 4,729,368 * 3/1988 Guitay ..... 601/6
4,883,047 * 11/1989 Guitay ..... 601/6
5,665,053 * 9/1997 Jacobs ..... 601/2
5,885,232 * 3/1999 Guitay ..... 601/6
5,891,064 * 4/1999 Van Herk et al. ..... 601/126
5,935,088 * 8/1999 Bosley ..... 601/7
6,017,320 * 1/2000 Bleeker et al. ..... 601/125
6,090,055 * 7/2000 Frajdenrajch ..... 601/7

FOREIGN PATENT DOCUMENTS 224 422 6/1987 (EP) .
2 723 310 2/1996 (FR) .

* cited by examiner

*Primary Examiner*—Michael A. Brown
*Assistant Examiner*—Benjamin K. Koo
(74) *Attorney, Agent, or Firm*—Browdy and Neimark

(57) ABSTRACT

The invention concerns a massage and skin suction apparatus comprising a housing whereof part (1*a*) of the wall is shaped to be used as a prehensile element and whereof the other part comprises at least a pair of parallel massaging rollers (6, 7) spaced from each other, each roller being mounted pivoting about its axis of revolution, said rollers (6, 7) being associated with means for driving them in rotation when they are in contact with the skin tissue, to exert thereon two opposed forces for pulling a portion of said tissue in the space separating them, in order to pinch it and a chamber connected to a suction source and provided with a suction aperture (4*a*), said suction aperture (4*a*) and said pair of massaging rollers (6, 7) being arranged on said housing for placing them simultaneously in contact with a portion of the skin tissue. The invention is characterised in that the edge of said suction aperture (4*a*) extends laterally at the peripheral surface of one (7) of said rollers (6, 7).

14 Claims, 5 Drawing Sheets

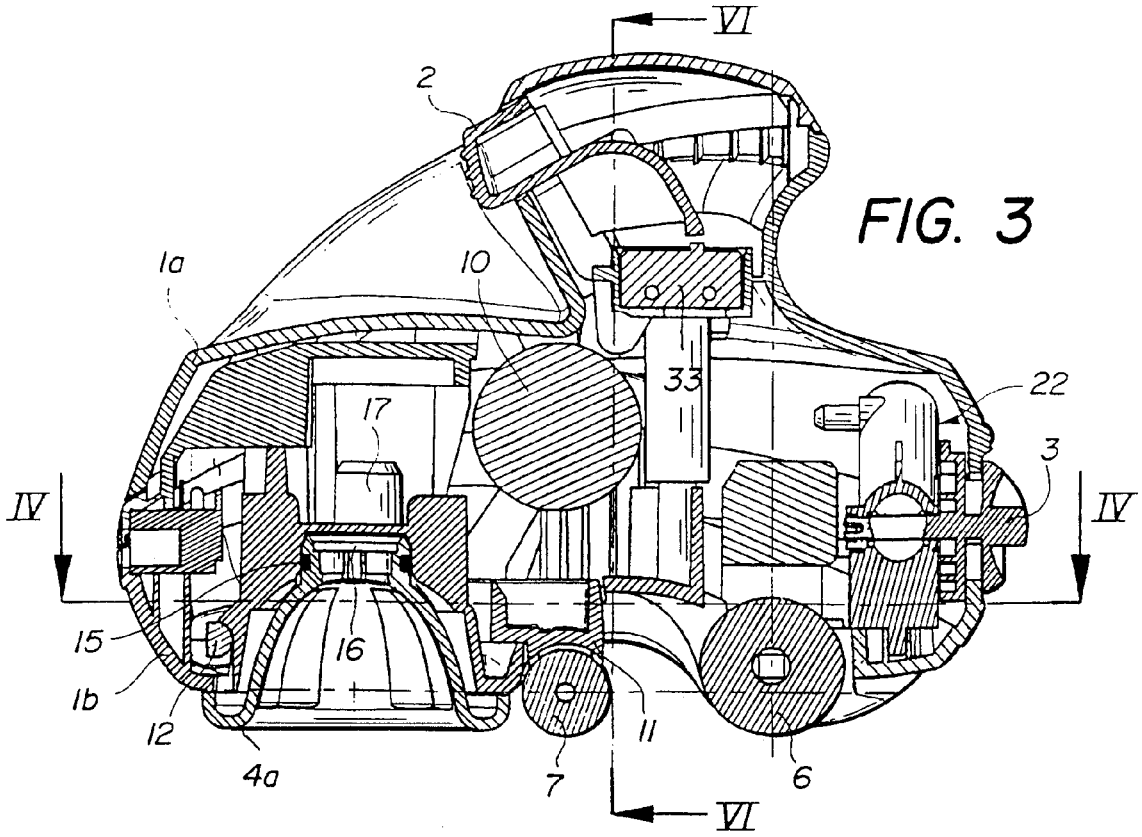
FIG. 3
FIG. 4
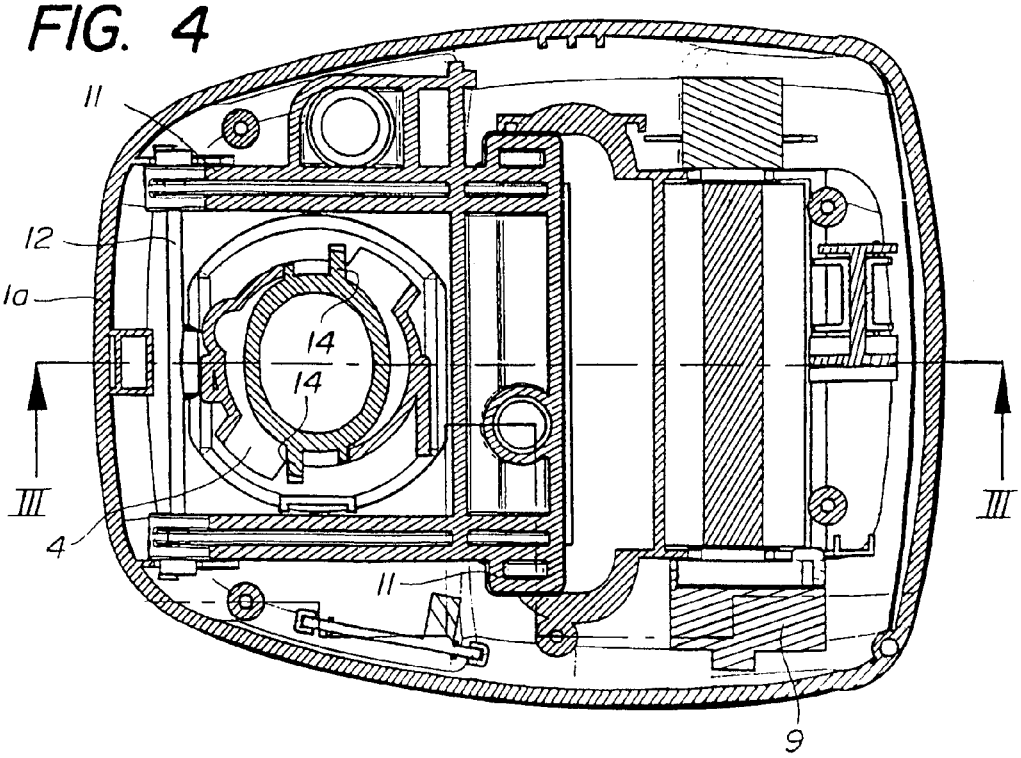

MASSAGE AND SKIN SUCTION APPARATUS

This application is the national phase of international application PCT/FR98/02738 filed Dec. 15, 1998.

TECHNICAL FIELD

The present invention relates to a massage and skin suction apparatus comprising, a housing of which one part of the wall is shaped to serve as a grasping element and of which another part comprises at least one pail of parallel massage rollers spaced from one another, each roller being mounted for pivoting around its axis of rotation, these rollers being associated with means for driving one or both of them in rotation when they are in contact with skin tissue to exert thereon two opposed forces that pull one portion of this tissue into the space separating them, in order to pinch it and a chamber connected to a suction source and furnished with a suction aperture, said suction aperture of said pair of massage rollers being disposed on said housing to permit them to be simultaneously placed in contact with a portion of the skin tissue.

Successful use has been made of two physical treatments to reduce, or even erase, the unsightly and uncomfortable effects of cellulite, as a question of massage of the type called "palpate-roll", which consists in forming a skin fold by compressive pinching and in displacing it by causing this fold to "roll" in proportion with the displacement. The other treatment is hypervascularization associated with tissue and lymphatic suction drainage using local suction techniques effectuated on the parts to be treated.

Cellulite is manifested by a hypertrophy of the fatty lobes of the hypodermas leading to a retraction of the vertical walls of the connecting tissue, which pulls the dermis and the epidermis on the hypertrophied fatty lobes. It is this which gives the skin affected with cellulite this aspect resembling all orange peel. The "palpate-roll" type of massage has a defibrating effect: the pressure followed by the pulling applied to the skin tissue has as its effect to stimulate the elastin fibers. Stimulation of the fibers, associated with decongestion of the tissues, has for its effect to return to the so skin its good tone. The defibrating improves the trophicity of the tissues and acts on their restructuring. Progressive placing under tension of the tissues at the level of the rolled skin fold accelerates the phenomenon of tissue softening. The releasing of the fibers of the vertical walls limits the stresses responsible for "orange peel".

Hypervascularization provokes a blood mobilization in the capillaries improving the trophicity and the cellular nutrition in depth and at a distance. The suction drainage improves the trophicity and simultaneously softens the tissues leading to a better sliding of the skin tissue layers. It permits liquids (interstitial liquids, water, blood, lymph) to better transport the nutrient supply and to better evacuate toxins. The tissue spaces are better drained. Finally, the light traction exerted on the tissues permits the opening of the lymphatic walls and facilitates the mobilization of the lymph.

PRIOR ART

There has already been proposed massage apparatus with rollers, notably in FR-934 070, FR-727 291, as well as in EP-0 538 142. These appliances have two rollers or more, driven in rotation in the same direction or in opposite directions. One of these rollers can also be fixed and adjustment of the distance between the rollers is envisioned in certain cases.

There are equally known from DE-34 01 522, CH-286 671, CH-168 279 and FR-854 937 apparatus for skin massage by suction, comprising a chamber furnished with a suction aperture, connected to a suction source intended to create a low pressure in this chamber when the edge of the suction aperture is applied against the skin surface to be treated. Certain of these apparatus permit adjustment of the value of low pressure at the interior of the chamber.

It has already been proposed to combine these two types of massage by associating on the same apparatus massage rollers of the type mentioned above disposed at the interior of a chamber connected a suction source. Such appliances are described particularly in the following documents: CH-206 851, U.S. Pat. No. 2,574,601, U.S. Pat. No. 397 024, FR-1 590 131, EP-O 284 527, FR-2 057 514, FR-2 579 100, FR-2 589 726 et FR-2 723 310. The shortcoming of these solutions resides in the fact that the pinching of the skin tissue resulting from the "palpate-roll" action of the rollers situated in the suction chamber provokes a folding of the skin tissue which is capable of having an influence on the seal between the chamber aperture and the skin and thus on the low pressure applied on the surface to be treated. Moreover, the low pressure existing in the chamber has an influence on the action of the rollers, so that it is not possible to independently regulate the action of these two massage devices since these latters have influences which are not controllable, to the extent where the nature of the skin to be treated intervenes as a parameter. Consequently, it is not easy to regulate the parameters related to these two massage means since these latters influence one another, but in a different manner according to the texture of the skin on which the apparatus is utilized.

SUMMARY OF THE INVENTION

The object of the present invention is to overcome, at least in part, the above-mentioned shortcomings, in a manner to permit the two above-mentioned massage means to be united in the same apparatus, not only in order that these not have a harmful influence on one another, but to the contrary in an unexpected manner, permitting production of a certain synergistic effect between these massage means of the apparatus according to the invention.

For this purpose, the present invention has for its object an apparatus for massage and skin suction of the type mentioned above, characterized in that the edge of said suction aperture extends laterally to the peripheral surface of one of said rollers.

Advantageously, the edge of said suction aperture extends laterally to the surface of the space separating said rollers.

This arrangement permits elimination of the undesirable interferences of the two massage means disposed on the same apparatus. By this fact, it is possible to regulate their respective actions in a totally independent manner, uniquely as a function of the texture of the skin.

Preferably, this apparatus comprises means for driving at the surface of the skin tissue in a direction transverse to the axes of rotation of the rollers.

Advantageously, said means for driving are connected to that one of said massage rollers which is more remote from said suction aperture and the driving direction of this roller is selected to produce, simultaneously with the massage, a displacement of said housing at the surface of the skin tissue directed in a manner to cause said suction aperture to be preceded by said massage rollers.

For example, these means for driving can be constituted by an electric motor connected by a speed reducing gear train to that one of said massage rollers which is the most remote from said suction aperture.

Due to this arrangement, the driving roller exerts on the skin a force directed toward the suction aperture, which, by the low pressure which it applies with the force against the skin opposes the advance of the appliance. It results from these two competing actions that the surface of the skin situated between the driving roller and the suction aperture tends to crease, aiding the "palpate-roll" action. Contrary to that which occurs in the case of appliances of the prior art combining the two massage means, this synergy is a constant which varies only as a function of the texture of the skin and of the braking force developed by the low pressure existing in the suction chamber. In contrast, this low pressure is not random as in the case of prior art apparatus, because of the harmful influence which the fold formed at the surface of the skin had on the seal between the suction aperture and the skin. This low pressure, perfectly controllable, thus permits setting of the braking force opposed to the advance of the appliance and, consequently, formation of the skin fold.

Preferably, the massage roller, situated adjacent to said suction aperture, is free around its axis of rotation.

Due to this freedom, this roller is driven by rubbing with the skin and can thus turn at a peripheral speed different from that of the driving roller permitting the skin fold to be guided between the rollers, the formation of this fold resulting primarily from the braking force mentioned above.

In a preferred form of the invention, the axis of rotation of the massage roller adjacent to said suction aperture is fixed to adjustment means capable of displacing it parallel to itself between at least two positions. This adjustment permits varying the height of the skin fold formed and thus the pinching effect exerted oil the skin and thus to adapt the pinching force to the nature of the skin, as well as to the resistance to pain of the person utilizing this apparatus.

Usefully, the means for controlling the suction and the means for driving the rollers in rotation comprise a sensor of critical situations, such as jamming of the skin or of a finger in a roller, or mechanical jamming of one of the rollers, in order to interrupt said suction and said driving in rotation.

Usefully, an appliance according the invention comprises a housing of two parts, an upper part in the form of a large handle to permit gripping and controlling of the apparatus, and a lower part comprising the means for massage and suction necessary for the treatment.

According to a first version, the handle is furnished with a control button having a double function of closing the pneumatic circuit of the suction chamber and of activating an electric switch for turning on the motor for driving the roller and the suction pump.

Preferably, however, the driving roller is arranged in the apparatus in such a manner as to be movable in a direction substantially perpendicular to the surface of the skin against an elastic biasing means, a displacement of said roller rocking a switch for controlling the means for driving, such as a motor for driving the roller, and, if desired, the suction pump.

Thus, it becomes possible to start the appliance simply by placing it flat on the skin, without having necessarily to grip it by the handle, but by holding it at one or several locations anywhere on the housing. This great freedom of grasping is particularly advantageous when the user wishes to massage a rear zone, for example, the rear of the thighs.

In effect, it was possible in the previous configuration to start the appliance when it was not correctly applied onto the surface of the zone to be treated. If the appliance were positioned in such a manner that only the motorized roller was in contact with the skin, a premature starting would only have provoked an advance of the apparatus without formation of a fold or suction. In contrast, if the apparatus were positioned in such a manner that it was only the suction aperture of the suction chamber which was in contact with the skin, a premature start up would have provoked suction without displacement which could lead to a local bruise.

Thus, in the present configuration, the apparatus is only started if it is correctly applied flat against the skin to be treated, thus assuring its maximum effectiveness by the effective simultaneity of the effects of palpate-roll and suction.

The means for driving, particularly the driving motor, the gear train, and the motorized roller can be installed within a cradle mounted to be pivoting along an axis parallel to and spaced from that of the motorized roller such that seen in a plane parallel to the surface of the skin, the cradle being capable of coming to bear against the switch in opposition to the biasing means.

In this configuration, the circular arc of the angle at the small peak described by the motorized roller is comparable to a translation perpendicular to the surface of the skin. The advantage is that one can dispose the switch at multiple locations within the housing in such a manner that it will be directly activated by this cradle.

Alternatively, the axis of the motorized roller and the directly associated gear or gears are mounted in a frame movable in translation in a slide perpendicular to the surface of the skin, the first associated gearing being found substantially in a same plane parallel to the surface of the skin as a leading fixed tooth wheel, the frame being capable of coming to bear against the switch in opposition to the biasing means.

If this arrangement places fewer parts in movement, it assumes an engagement by deep teeth tolerating a certain play between the leading fixed tooth wheel and the first gear affixed to the frame.

BRIEF DESCRIPTION OF THE DRAWINGS

The invention will be better understood from a study of an embodiment of the apparatus object of the present invention, described hereafter, by way of a non-limiting example and illustrated in the attached figures in which:

FIG. 3 is a cross-sectional view along line III—III of FIG. 4;

FIG. 4 is a cross-sectional view along line IV—IV of FIG. 3;

BEST MANNER OF CARRYING OUT THE INVENTION

Figure 1:
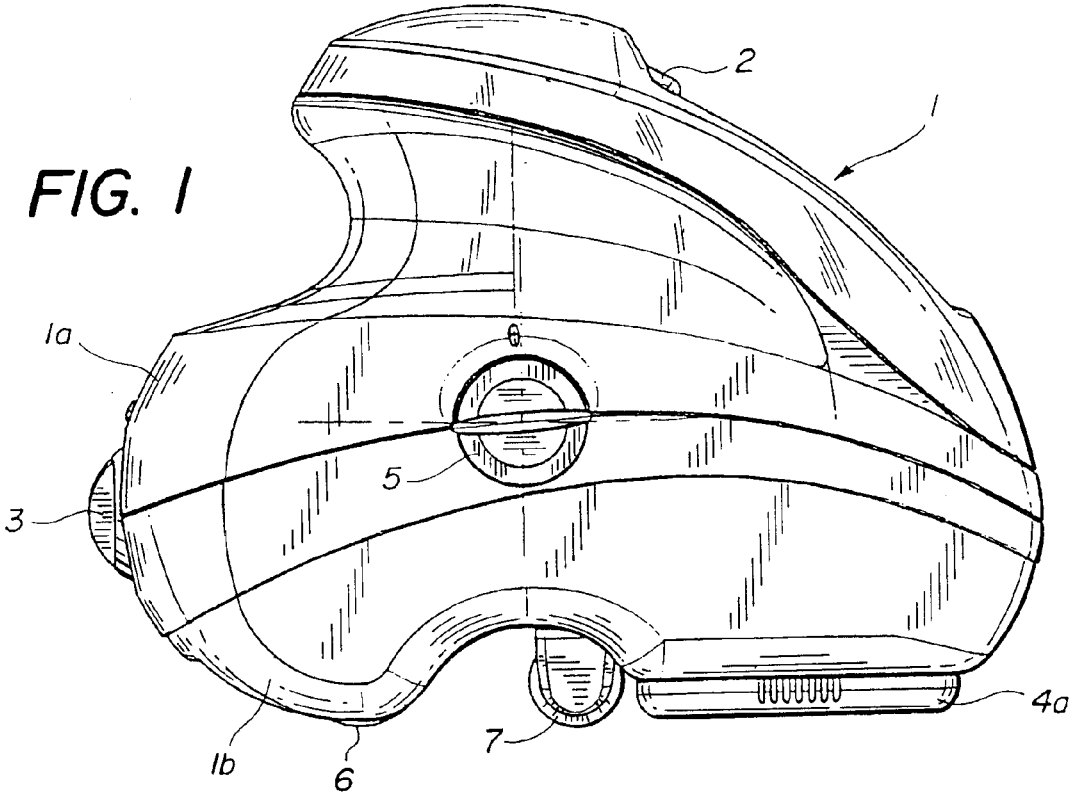
FIG. 1 is a side view and elevation of this embodiment.
Figure 2:
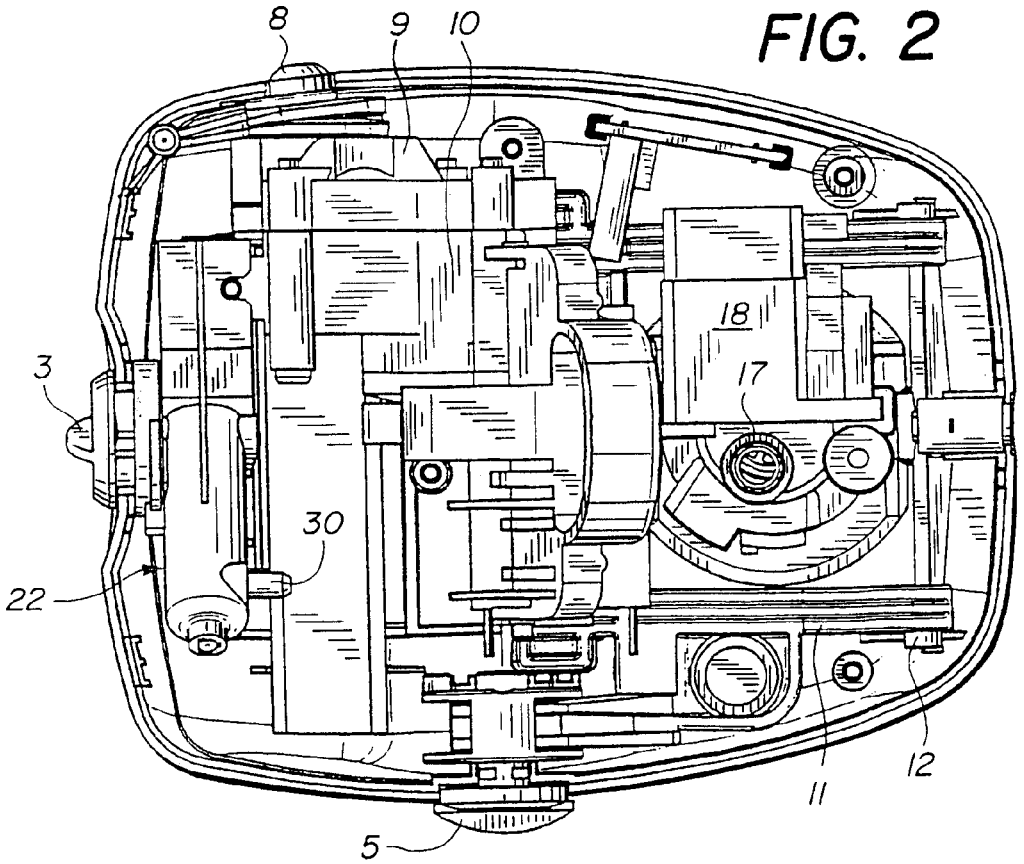
FIG. 2 is a top view of FIG. 1, with the upper part of the housing removed.

The apparatus illustrated in FIGS. 1 to 3 comprises a housing 1 of two parts, an upper part 1*a* shaped to permit grasping and control of the apparatus, and a lower part 1*b* comprising the massage and suction means necessary for treatment. These two parts 1*a*, 1*b* are assembled with one another. Four controls pass through the wall of housing 1, they arc an on/off push button 2, an adjustment button 3 for the low pressure in a suction chamber 4, having a suction aperture 4*a*, an adjustment button 5 for the spacing between the two massage rollers 6, 7 of which the respective axis of rotation are parallel and a pushbutton 8 (FIG. 2) for disengaging a massage roller 6. As is seen particularly in FIG. 1, the lower face of housing 1 comprises suction aperture 4*a* of suction chamber 4 disposed alongside massage roller 7, i.e., alongside and outside of the massage zone comprised between rollers 6, 7. The width of suction aperture 4*a* extends laterally to this surface from the space separating said rollers.

Figure 5:
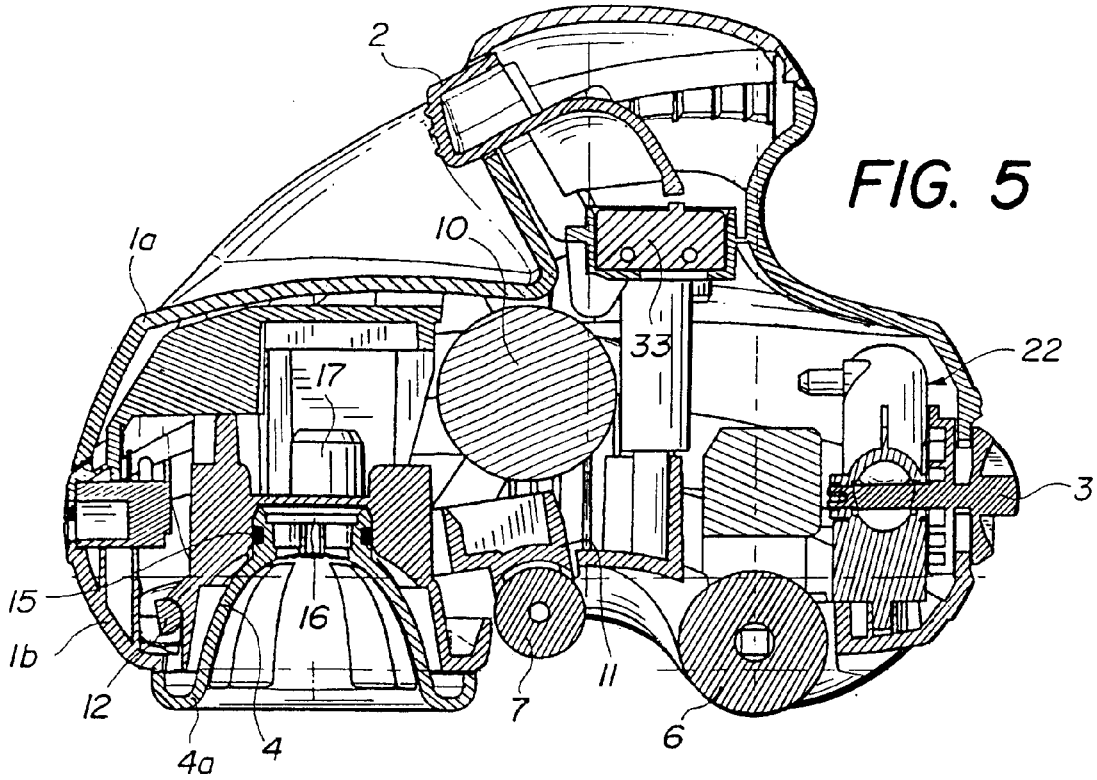
FIG. 5 is a view similar to that of FIG. 3, illustrating another position of the massage rollers.

The massage device with rollers 6, 7 comprises a massage roller 6 the extremity of which is fixed to a reducing gear train 9 (FIG. 2) disposed between this massage roller 6 and a drive motor 10, intended to drive this massage roller 6 in a clockwise direction if reference is made to the apparatus such as shown in FIGS. 3 and 5. As a result, the apparatus is displaced on the surface of the skin, massage rollers 6, 7 preceding suction chamber 4. Other than the fact that the braking generated by the suction cup effect of suction aperture 4*a* participates in the formation of the skin fold, one can also note that defibrating of the skin tissue engendered by the "palpate-roll" preceding the suction, permits softening of the skin tissue and giving a maximum effectiveness to the hypervascularization.

Control pushbutton 8 (FIG. 2) is intended to act on the reducing train 9 in a manner to disconnect massage roller 6 from motor 10, thus permitting this roller 6 to turn freely. This liberation of massage roller 6 from drive motor 10 is useful particularly when hairs are caught in this roller.

Figure 6:
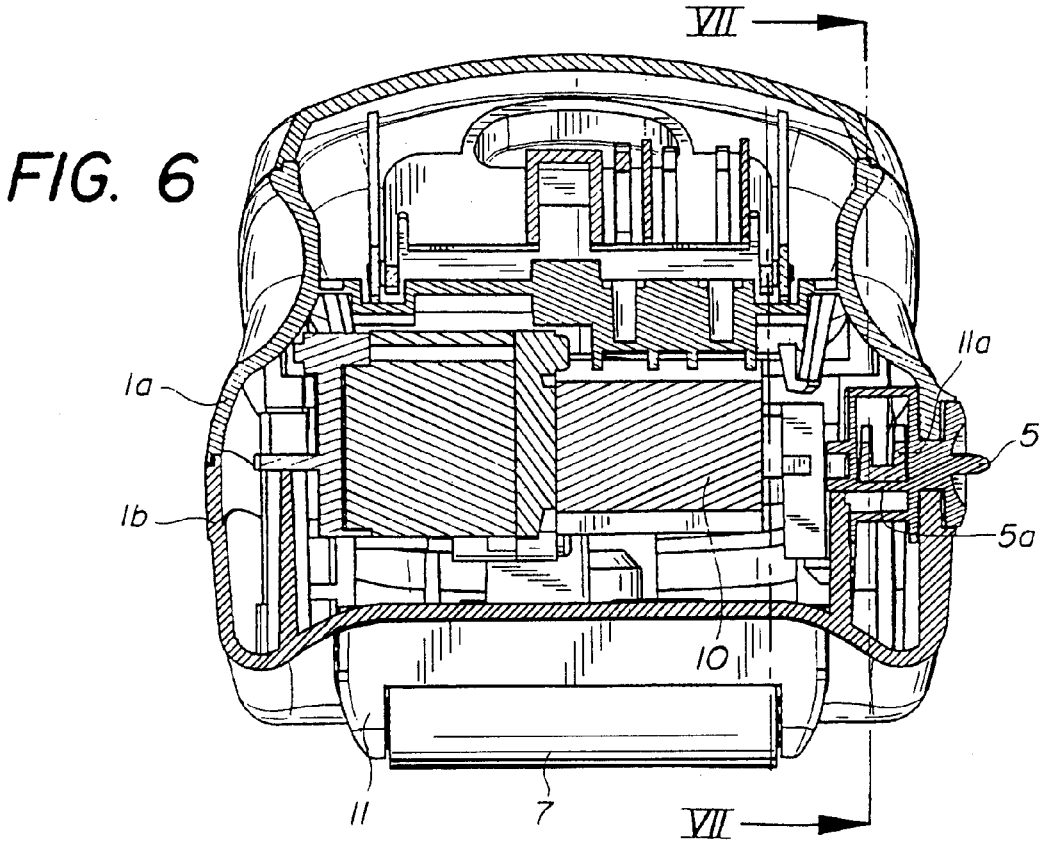
FIG. 6 is a cross-sectional view according to lines VI—VI of FIG. 3.
Figure 7:
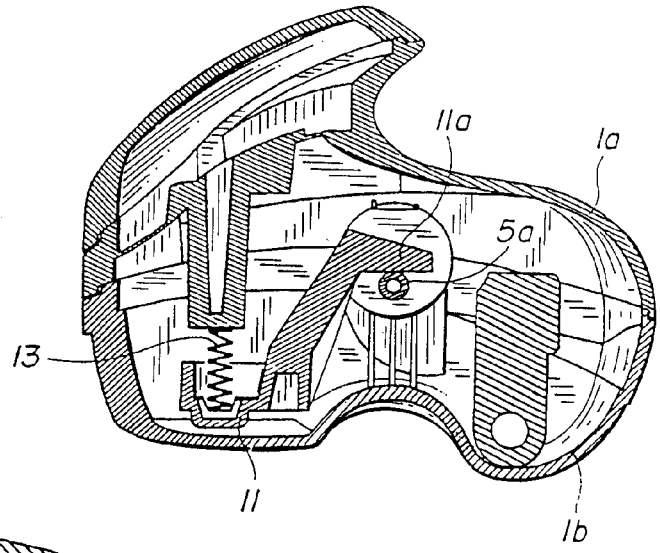
FIG. 7 is a cross-sectional view along line VII—VII of FIG. 6.

The second massage roller 7 is free to turn around its axis fixed on a support 11 (FIGS. 3, 4, 5, 6 and 7) articulated around an axle 12. This support 11 is pressed toward the bottom by a spring 13 (FIG. 7) which applies a bearing element 11*a* (FIGS. 6 and 7) of this support 11 against an eccentric clement 5*a* of control button 5. By turning this control button 5, one causes support 11 to pivot around its axle 12. The two extreme positions that support 11 and consequently massage roller 7 can occupy are illustrated by FIGS. 3 and 5. The position illustrated by FIG. 3 corresponds to that of maximum pinching of the skin between rollers 6 and 7, while FIG. 5 illustrates the position of minimum pinching all of the intermediate positions being able to be obtained by turning control button 5.

The function of a massage by "palpate-roll" is obtained by massage rollers 6 and 7 due to the rotation of driving roller 6 which, by its rotation, provokes simultaneously displacement of the apparatus on the surface of the skin in forming a skin fold between massage rollers 6 and 7. This effect of folding the skin as the apparatus is advanced is aided by the braking exerted by suction chamber 4 which is opposed to this advance. By this fact, at least in the initial phase of massage, driving roller 6 turns slightly more than roller 7 braked by the suction cup effect of suction chamber 4, so that the two opposing forces exerted on the portion of skin tissue situated between rollers 6 and 7 permits the formation of the fold and the effect of "palpate-roll" as the apparatus is advanced.

This suction enclosure 4 is fixed in a removable manner on housing 1 of the apparatus. In this example, a bayonet attachment 14 (FIG. 4) connects suction chamber 4 to the lower part 1*b* of housing 1. A seal 15 is interposed between this suction chamber 4 and this housing 1 (FIGS. 3 and 5). The bottom of this suction chamber 4 comprises a space 16 intended to receive a filter. This is preferably a metal filter capable of being cleaned by passing it under running water from a faucet. The part of housing 1 receiving the bottom of this suction chamber 4 is traversed by a tubular conduit 17.

Figure 8:
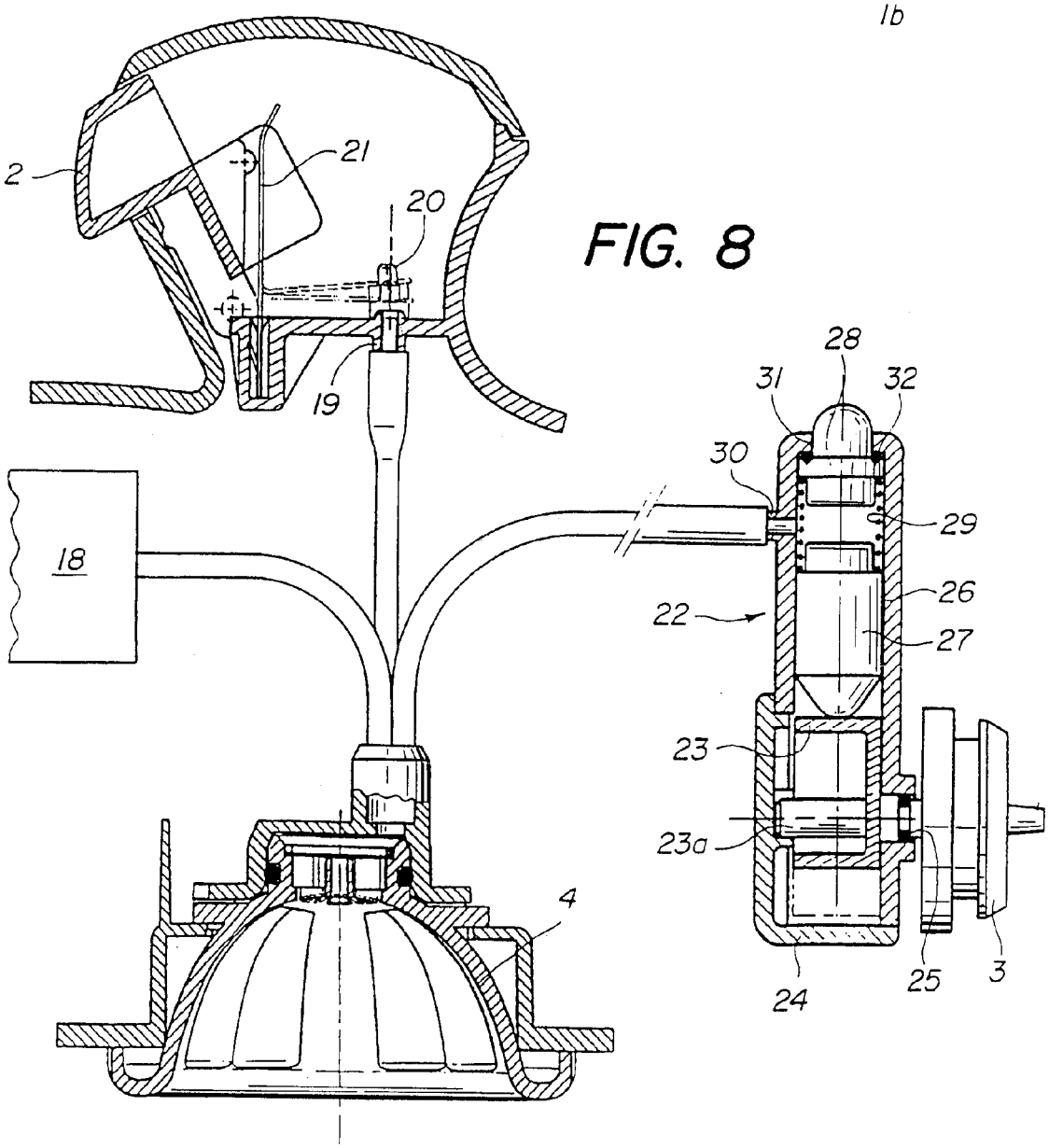
FIG. 8 is a schematic view of the pneumatic circuit.

As is seen in particular in FIG. 8, this tubular conduit 17 serves to connect suction chamber 4 to three different systems. The first of these systems is a pump 18 intended to create a low pressure in suction chamber 4. If desired, this same chamber is connected to a conduit 19 communicating with the atmosphere, controlled by a closing valve 20 fixed to a bias spring 21 associated with on/off pushbutton switch 2 located in the handle to bring this pushbutton into the off position of the apparatus as soon as a pressure ceases to be exerted on this pushbutton 2. Finally, this chamber 4 is also connected to a pressure regulator 22 associated with the control button 3. This pressure regulator 22 comprises a cam 23 fixed to a shaft 23*a* on which is fixed the control button 3. This cam 23 is housed in a housing 24 which shaft 23*a* traverses in a sealed manner due to a seal 25. A cylindrical housing 26 communicates with housing 24, perpendicularly to the axis of rotation of cam 23. This cylindrical housing comprises two pistons 27 and 28 between which a helical spring 29 is interposed. A conduit 30, extending laterally to the cylindrical housing 26 connects this housing to suction chamber 4. An axial opening 31 connects this cylindrical housing 26 to the atmosphere and is closed by a seal 32 applied against the edge of opening 31 by piston 28.

In causing cam 23 to turn with the aid of control button 3, helical spring 29 is more or less armed, so that piston 28 applies with more or less force seal 32 against the edge of opening 31. As soon as the low pressure in suction chamber 4 exceeds the force exerted by spring 29 on piston 28, this latter is displaced against the pressure of spring 29 and permits atmospheric air to penetrate into cylindrical housing 26 through opening 31 until the low pressure is balanced with the pressure of helical spring 29.

As one can note, the two devices for adjusting the spacing of massage rollers 6, 7 and the low pressure in suction chamber 4 have an action totally independent of one another, the adjustment of one not having any repercussion on the other.

In contrast, as has already been noted, driven roller 6 exerts a force on the skin directed toward suction chamber 4, suction aperture 4*a* thereof exerting a braking on housing 1, by the suction cup effect created by the low pressure. This braking with respect to driven roller 6 is opposed to the advance of the apparatus at the surface of the skin, which permits the formation of the skin fold between massage rollers 6 and 7.

The removable attachment of suction chamber 4 to housing 1 of the apparatus permits facilitating cleaning of impurities aspirated to the bottom of this chamber and retained by the filter disposed in housing 16. This assembly of this suction chamber 4 can be effectuated by hand, without any tool, due to its bayonet attachment 14. Preferably a second filter, not represented, constituted by a foam with open pores is further disposed between the first filter and pump 18 in order to improve its protection and to filter finer impurities which would have been able to pass through the first filter placed in housing 16. This latter is preferably formed of a wire grille of which the mesh size is 200 $\mu$m.

We will give, by way of example, several indications relative to the dimensioning of the apparatus. The diameter of driven massage roller 6 is 23 mm, while that of free massage roller 7 is 14.5 mm. As illustrated on FIGS. 3 and 5, the height of roller 7 can be adjusted on a vertical path of 10 mm. A raised position of roller 7, or a relatively large distance between the rollers, is more particularly adapted to persons starting treatment or having a high sensitivity to pain (FIG. 5). In the lowered position of roller 7, or for a smaller distance between the rollers, the skin fold is high and narrow and consequently the "palpate-roll" action is more effective, but also more painful. The greater the distance, the less the height of the fold and consequently the "palpate-roll" action is less effective but also less painful. The horizontal distance between massage rollers 6 and 7 can be comprised between 25 mm and 45 mm. One can envision another supplementary device to regulate this horizontal distance.

The speed of displacement of the apparatus driven by massage roller 6 is of the order of 60 mm/s for a maximum effectiveness. This speed is sufficient to assure an effective massage without being excessive to present the risk of heating the skin and rendering the operation disagreeable. The material and surface state of massage rollers 6, 7 and more particularly of roller 6 serving as the driving roller of the apparatus are selected to develop a sufficient rubbing force with the skin to optimize the formation of the fold. To this end, the surface of massage roller 6 can be covered with a plastic material or an elastomer, particularly a thermoplastic elastomer. This material is equally selected to be resistant to cleaning agents in a manner to permit a good level of hygiene of the appliance to be maintained as well as to avoid allergy problems.

Free massage roller 7 is maintained in place by spring 13 which bears on its support 11. In the case where the force to pinch the skin would become abnormal and exceed the pressure exerted by spring 13, support 11 can lift up, augmenting the spacing between massage rollers 6 and 7, thus limiting the pinching force. By this fact, spring 13 acts as a safety permitting the maximum pinching force to be limited to a determined value which limits, or even prevents, the risk of producing a bruise. According to the force of spring 13, adjustment of the spacing between massage rollers 6 and 7 can be produced automatically as a function of the texture of the skin. But of course it is always possible to adjust this spacing with the aid of control button 5 which can be displaced between different intermediate positions, a notching of this button 5 permitting maintenance of an angular position corresponding to the desired spacing.

Button 3 for adjusting the low pressure in suction chamber 4 can comprise, for example, five angular positions distributed over 360° and corresponding to respective pressures of 7.5; 10; 15; 20 and 25 kPa, the average value of use being 15 kPa. This button can also comprise a sixth on/off position.

The value of the flow rate of pump 18 is, in this example, 2 l/min which permits an almost immediate suction upon placing edge 4*a* of chamber 4 in contact with the skin, thus not necessitating any waiting time.

Preferably, suction aperture 4*a* of suction chamber 4 is of elliptical form of 35×45 mm, the major axis of the ellipse being parallel to the axes of massage rollers 6, 7.

When it is present, pushbutton 2 has two functions, that of closing the pneumatic circuit comprising pump 18 and suction chamber 4 with the aid of the valve 20 and actuation of an electric switch 33 (FIGS. 3 and 5) for turning on motor 10 and pump 18. As soon as the pressure on pushbutton 2 ceases to be exerted, bias spring 21 is brought into a rest position, halting motor 10 and pump 18 and placing the pneumatic circuit at atmospheric pressure. This placing of the pneumatic circuit at atmospheric pressure almost simultaneously with stoppage of pump 18 and motor 10 facilitates unsealing of suction aperture 4*a* of suction chamber 4 in case of an emergency. Control of the apparatus necessitating the exertion of a constant pressure on pushbutton 2 guarantees that this will operate only during times strictly necessary for a massage, limiting annoying noise to the minimum necessary.

Figure 9:
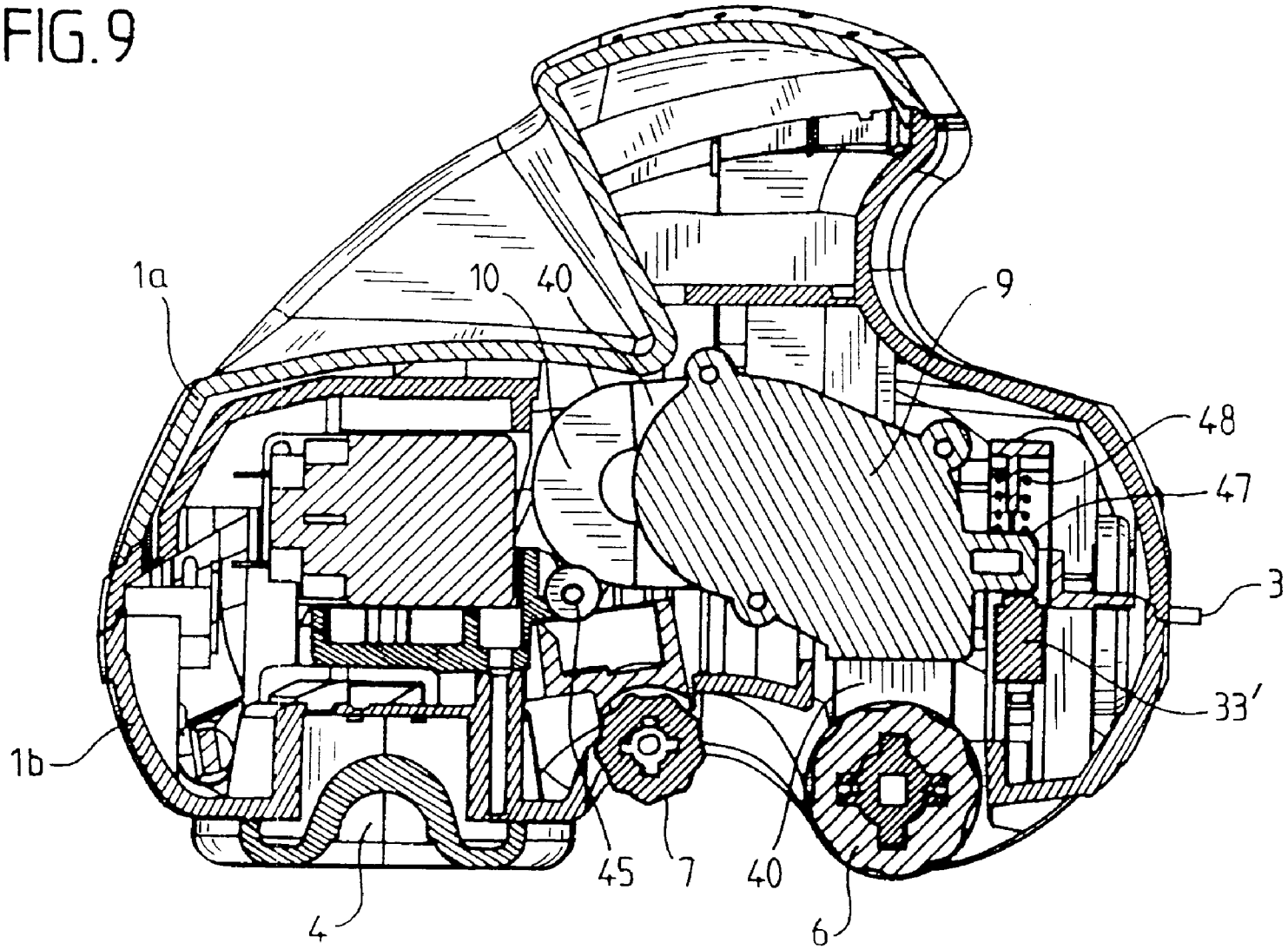
FIG. 9 is a view similar to that of FIG. 3, illustrating another arrangement of the control means.

Alternatively and as illustrated in FIG. 9, switch 33 can be rearranged in the apparatus to a position 33' in such a manner that it will only be turned on when pressure is effectively applied on massage roller 6, normally when the apparatus is correctly pressed on the user's skin.

To this end, motor 10 and reduction gear train 9 are arranged within a cradle 40 carrying on one side massage roller 6 and being mounted at the other side to pivot about an axis 45 parallel to the roller. A protrusion 47 arranged on the cradle at the same side as the roller is pushed by a spring 48 toward the bottom by bearing against switch 33'. Thus, a pressure greater than that of spring 48 exerted on the roller causes cradle 40 to rise along a circular arc in the counter-clockwise direction, freeing switch 33' which can turn on the motor 10 for driving the roller.

According to an advantageous variant, the freeing of switch 33' turns on at the same time motor 10 driving the roller and suction pump 18 for a simultaneous operation.

Alternatively, there can be provided one or several switches permitting turning on separately massage rollers 6, 7 and suction pump 18.

One can equally envision that switch 33' is arranged at the side of spring 48 a little above protrusion 47, the cradle then resting against an abutment. One can equally envision that motor 10 and motor reducer 9 are fixed and that roller 6 is mounted within a frame sliding vertically in slides in opposition to a spring, gears directly associated with the roller and belonging to the frame being found practically with a certain play at the level of the latter gear driving the motor reducer.

Other improvements can be provided to the apparatus in the framework of the claims.

POSSIBILITY OF INDUSTRIAL APPLICATION

The invention finds its application in the technical field of apparatus for massage and skin suction.

What is claimed is:

1. A massage and skin suction apparatus comprising: a housing (1) having a first part (1*a*) shaped to serve as a grasping element and a second part (1*b*); at least one pair of parallel massage rollers (6, 7) spaced from one another, each roller being mounted in said second part for rotation around a respective axis of rotation; means (9,10) associated with one of said rollers (6, 7) for driving said one of said rollers in rotation when said rollers are in contact with the skin tissue, to exert on said rollers two opposed forces for pulling a portion of the skin into the space separating said rollers, in order to pinch the skin; and a chamber (4) connected to a suction source (18) and furnished with a suction aperture (4*a*), said suction aperture (4*a*) and said pair of massage rollers (6, 7) being disposed on said housing (1) in order to permit said suction aperture and said rollers to be simultaneously brought into contact with a portion of the skin, characterized in that said suction aperture (4*a*) has an edge that extends laterally to the peripheral surface of one (7) of said rollers (6, 7) and said suction aperture is located outside of the space between said rollers.

2. Apparatus according to claim 1, characterized in that said means (9, 10) for driving act to drive said apparatus in a direction transverse to the axes of rotation of said rollers (6, 7).

3. Appliance according to claim 2, characterized in that said means for driving (9, 10) are connected to that one (6) of said massage rollers (6, 7) which is most distant from said suction aperture (4*a*) and in that the direction of driving of said roller (6) is selected to produce, simultaneously with the massage, a displacement of said housing (1) at the surface of the skin tissue directed in a manner to cause said suction aperture (4*a*) to be preceded by said massage rollers (6, 7).

4. Apparatus according to claim 1, characterized in that the one of said rollers (7) that is situated adjacent to said suction aperture (4*a*), is free to rotate around its axis of rotation.

5. Apparatus according to claim 1, characterized in that the axis of rotation of the one of said rollers (7) that is adjacent to said suction aperture (4*a*) is fixed to adjustment means (5, 11 ) capable of displacing that one of said rollers parallel to itself between at least two positions.

6. Apparatus according to claim 5 characterized in that the one of said rollers (7) that is adjacent to said suction aperture (4*a*) is mounted on a support (11) articulated to the housing around an axis parallel to its axis of rotation, this support being connected with an eccentric (5*a*) capable of causing that one of said rollers to pivot around its articulation axis, elastic means (13) serving to apply this support against said eccentric (5*a*).

7. Appliance according to claim 6, characterized in that said elastic means (13) apply said support (11), against the pressure exerted thereon during formation of the skin fold, these elastic means (13) being dimensioned in a manner to permit the displacement of said support (11) when the pressure associated with formation of said skin fold exceeds a determined value.

8. Apparatus according to claim 1, characterized in that the diameter of the one of said rollers (7) that is adjacent to said suction aperture (4*a*) is substantially less than that of the other (6) of said rollers.

9. Apparatus according to claim 1, characterized in that said apparatus further comprises means (3, 22–32) for adjusting the pressure at the interior of said chamber (4).

10. Apparatus according to claim 1, characterized in that said chamber (4) is mounted in a removable manner on said housing (1).

11. Apparatus according to claim 10, characterized in that said chamber (4) is fixed by a bayonet assembly (14) on said housing (1).

12. Apparatus according to claim 1, characterized in that said apparatus further comprises means (3, 22–32) for adjusting the pressure at the interior of said chamber (4) for control of the suction, and said means for adjusting the pressure and said means for driving said one of said rollers in rotation comprise a sensor of critical situations Lo interrupt said suction and said driving in rotation.

13. Apparatus according to claim 3, characterized in that said one of said rollers (6) is arranged in said housing (1) in such a manner as to be movable in a direction substantially perpendicular to the surface of the skin against an elastic biasing means (48), a displacement of said one of said rollers rocking a switch (33) for control of at least one of said means for driving (9, 10) and said suction source (18).

14. Apparatus according to claim 13, characterized in that the means (9, 10) for driving and said at least one roller (6) are installed within a cradle (40) mounted pivotably about an axis (45) parallel to and spaced from that the axis of said at least one roller such that, viewed in a plane parallel to the surface of the skin, the cradle is capable of coming to bear against the switch (33) in opposition to the biasing means (48).

* * * * *